United States Patent [19]

Hollis et al.

[11] Patent Number: 4,679,602

[45] Date of Patent: Jul. 14, 1987

[54] REMOVABLE DEVICE FOR REPEATEDLY PRESSURIZING A CONTAINER

[76] Inventors: Glenn E. Hollis, 3621 Belcher Dr., Tampa, Fla. 33609; Craig E. Hollis, 3520 Cleveland Heights Blvd., Lakeland, Fla. 33903

[21] Appl. No.: 402,347

[22] Filed: Jul. 27, 1982

[51] Int. Cl.[4] ..... B65B 3/04

[52] U.S. Cl. ..... 141/19; 141/95; 261/DIG. 7

[58] Field of Search ..... 141/37, 39–67, 141/250–284, 285–310, 69–70, 382–388, 19, 329, 330, 17, 94, 95, 96; 261/DIG. 7

[56] References Cited

U.S. PATENT DOCUMENTS

| | | | |
|---|---|---|---|
| 1,425,614 | 8/1922 | Stickel | 141/95 |
| 2,605,763 | 8/1952 | Smoot | 141/19 |
| 2,805,846 | 9/1957 | Dewan | 261/DIG. 7 |
| 3,988,857 | 11/1976 | Baumann | 141/95 |
| 4,126,161 | 11/1978 | Sterling | 141/95 |
| 4,316,409 | 2/1982 | Adams | 261/DIG. 7 |

*Primary Examiner*—Houston S. Bell, Jr.

[57] ABSTRACT

It is a common experience to open a container of carbonated beverage. Upon use the opened beverage will quickly lose to carboration and become "flat". This device is for filling a container of carbonated beverage with a gas, under pressure, so as to preserve the carbonation of the beverage before or after use of the carbonated beverage.

1 Claim, 3 Drawing Figures

REMOVABLE DEVICE FOR REPEATEDLY PRESSURIZING A CONTAINER

BACKGROUND OF THE INVENTION

1. Field of the Invention

This invention relates to filling devices. More particularly, this invention relates to a device for filling a container containing a carbonated beverage with a gas, under pressure, so as to preserve the carbonation of the carbonated beverage.

2. Description of the Prior Art

It is well known that upon the opening of a bottle or can of carbonated beverage, the beverage will quickly lose its carbonation and become "flat". A decarbonated, flat beverage is, of course, unappealing to a typical consumer. As a result, the consumer ordinarily discards the remaining beverage left in the container which has become flat after opening.

In order to reduce the wastefulness of discarding decarbonated beverage, has been a practice of the bottling industry to bottle the carbonated beverage in relatively small size bottles such as 6½ ounce bottles, with the intent being that with such small sized bottles, all of the beverage contained therein would be consumed by the consumer before becoming flat. As the public became increasingly tolerant of the need to quickly consume the beverage after opening the container, the bottle manufacturers began bottling the carbonated beverage in larger sized containers such as 10 and 16 ounce bottles.

The great majority of the beverage bottles heretofore discussed were highly durable, and were designed to be returned to the bottling company for cleaning and subsequent refilling with the beverage. In order to eliminate the need for having to return the bottles for refilling, the bottling manufacturers began to bottle the carbonated beverage in 12 ounce cans, and then 12 ounce non-returnable bottles.

Unfortunately, the increased cost of bottling has dramatically increased the cost of the bottled beverage to the consumer. As a result, many bottling companies have elected to bottle their beverage in relatively large size containers such as quart size returnable and nonreturnable glass bottles and two liter disposable plastic bottles. Obviously, with such large size containers, the consumer cannot ordinarily consume the entire contents thereof. It is therefore necessary for the consumer to reseal the bottle and store it in a refrigerator for later use. Obviously, each time the bottle is opened, a certain amount of carbonation escapes from the carbonated beverage. It is usually the case that the carbonated beverage becomes flat before the consumer is able to consume all of the beverage. Accordingly, a substantial amount of beverage is unnecessarily wasted.

In view of the above, there presently exists a need in the carbonated beverage industry for a device for maintaining the carbonation of a beverage in a container until the beverage is completely consumed by the consumer. It has been suggested that some of the soda water dispensers such as those illustrated in U.S. Pat. Nos. 2,921,711, 2,705,578, 2,204,015, and 1,263,278, could be adapted to satisfy such need in the carbonated beverage industry. Unfortunately, upon review of the above mentioned patents, it is quickly seen that none of them are designed to be quickly removed entirely from the container to permit the beverage to be poured from the container, and then reinstalled on the container to recharge the container and maintain the carbonation of the remaining beverage.

Therefore, it is an object of this invention to provide an improved apparatus which overcomes the aforementioned inadequacies of the prior art devices and provides and improvement which is a significant contribution to the advancement of the carbonated beverage art.

It is another object of this invention to provide a device for maintaining the carbonation of a beverage stored within a container.

Another object of this invention to provide a device which may be repeatedly used to maintain the carbonation of a beverage when the container containing the beverage is repeatedly opened to dispense a portion of the carbonated beverage.

Another object of this invention is to provide a device for maintaining the carbonation of a carbonated beverage which is easily and quickly removed entirely from the container containing the carbonated beverage so as to permit the beverage to be easily poured from the container and/or to permit the device to be quickly and easily installed on another container for use.

Another object of this invention is to provide a device for maintaining the carbonation of a beverage which includes a compressed gas cylinder and a valve means to enable the consumer to charge the container containing the carbonated beverage with the gas thereby maintaining the carbonation of the beverage.

Another object of the invention is to provide a device for maintaining the carbonation of a beverage which further includes a pressure gauge for indicating to the consumer the pressure inside the container thereby enabling the consumer to properly pressurize the container without over-charging or under-charging the carbonated beverage therein.

Another object of this invention is to provide a device for maintaining the carbonation of a beverage wherein the pressure gauge is operatively connected to the valve such that the pressure inside the container is maintained at a predetermined amount necessary to charge the beverage to the proper pressure.

The foregoing has outlined some of the more pertinent objects of the invention. These objects should be construed to be merely illustrative of some of the more prominent features and applications of the intended invention. Many other beneficial results can be attained by applying the disclosed invention in a different manner of modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a device which is removably fitted to a container of a carbonated beverage to maintain the carbonation of the beverage between uses. More particularly, the device comprises a base having an elongated tube shaped housing operatively affixed to one end thereof for housing a pressure source such as a $CO_2$ cartridge or the like. The other end of the base is threaded to permit the device to be threaded onto the opening of the container containing the carbonated beverage. A valve is provided to permit the selective passing of the pressurized gas in the pressure container to flow into the container to pressurize the same.

During use, after the consumer has finished using the container and is ready to recap it, the consumer screws the device onto the open end of the container until the device is securely thereon. The consumer then opens the valve to permit the pressurized gas in the pressure container to flow into the bottle of beverage. After the beverage is sufficiently pressurized, the valve is moved to its off position. The beverage container is now ready for storage. When it is desirous to subsequently use the beverage container, the consumer merely unscrews the device from the open end of the beverage container, consumes a portion of the carbonated beverage and then reinstalls the device to recharge the beverage container described above.

The device further includes a pressure gauge which senses the pressure within the beverage container. This added feature of having a pressure gauge permits the consumer to visually determine the amount of pressure within the beverage container such that the consumer will not under-charge or over-charge the beverage. The pressure gauge may be operatively connected to the valve to automatically regulate the pressure within the beverage container.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject claims of the invention. It should be appreciated by those skilled in the art that the conception of the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

DETAILED DESCRIPTION OF THE PREFERRED EMBODIMENT

Figure 1:
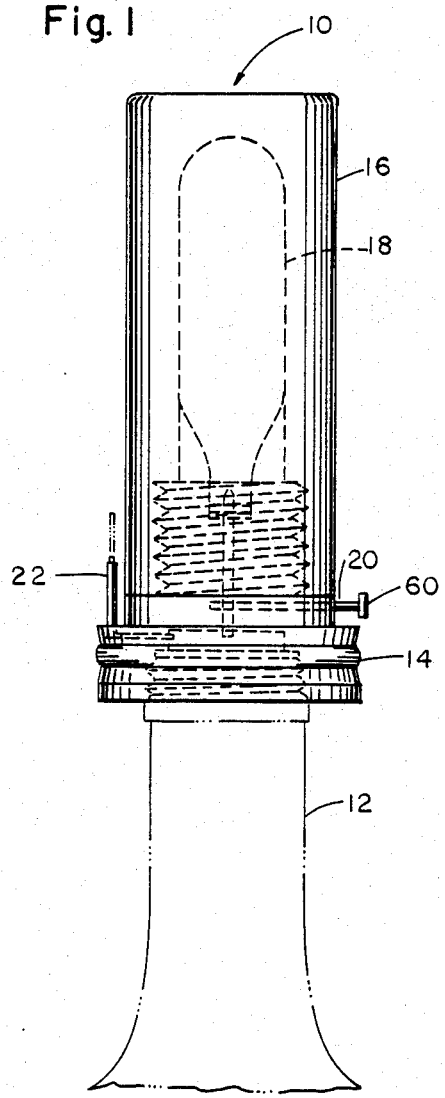
FIG. 1 is a frontal view of the device of the invention installed on the threaded opening of a beverage container.

FIG. 1 is a frontal view of the device 10 of the invention installed on a beverage container 12. Basically, the device 10 comprises a base 14 which threadably receives a housing 16 which houses a source of pressure such as a $CO_2$ cartridge or the like. A valve 20 is provided to permit the gas contained within the $CO_2$ cartridge 18 to flow into the beverage container 12. A pressure gauge 22 is operatively connected in fluid communication with the interior of the beverage container 12 to sense the pressure therein and provide a visual indication of such pressure to the consumer.

Figure 3:
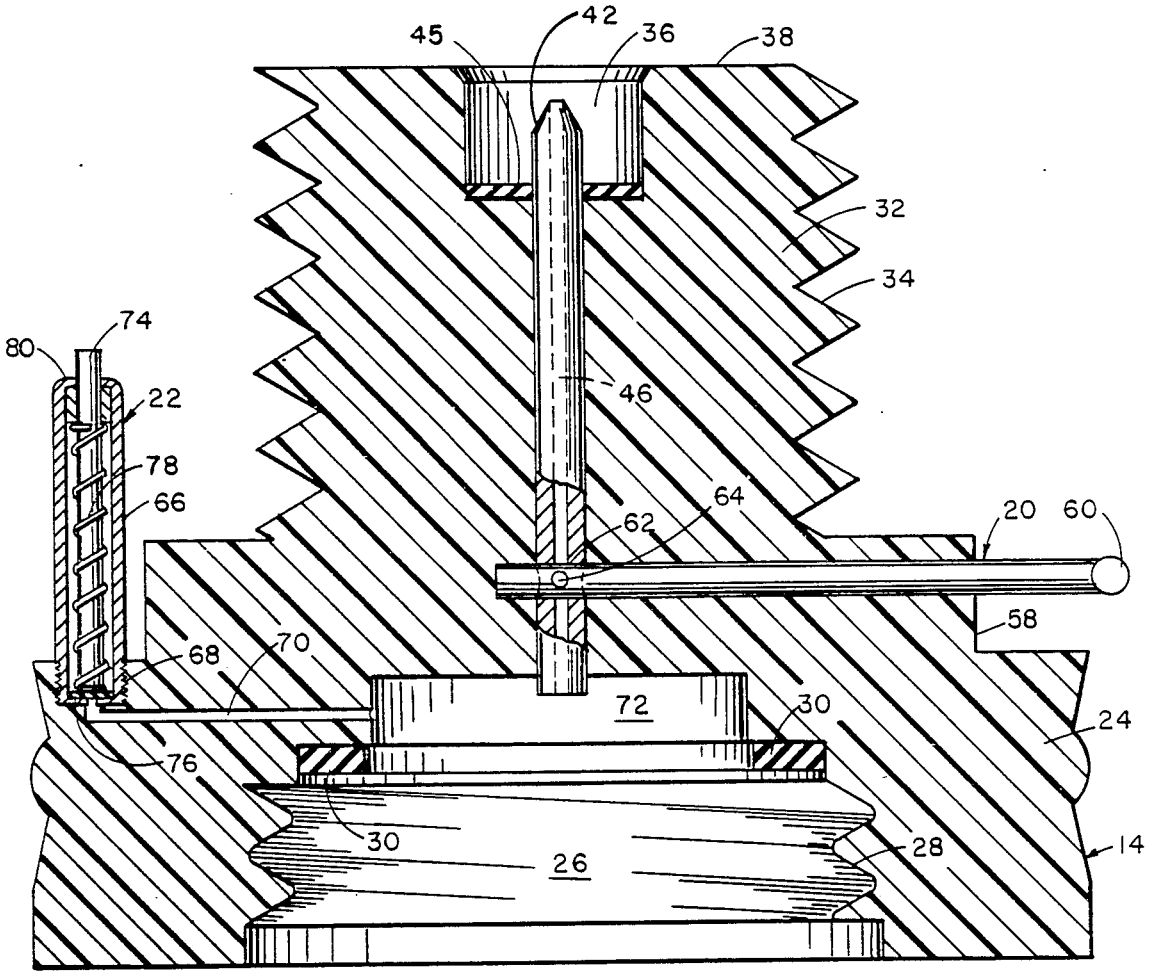
FIG. 3 is an enlarged view of the base of the device of the invention illustrating the valve for controlling the flow of the gas from the $CO_2$ cartridge into the beverage container and illustrating the pressure gauge which provides a visual indication to the consumer of the amount of pressure existing within the beverage container.

More particularly, as shown in FIG. 3, the base 14 comprises a main body portion 24 having an internal cavity 26. The inside wall 28 of the internal cavity 26 is threaded to threadably receive the threaded opening of the beverage container 12. An annular gasket 30 is seated within the upper surface of the internal cavity 26 in mating relationship with the upper rim of the opening of the container 12. The gasket 30 assures that an air tight seal will be formed between the internal cavity 26 and the inside of the beverage container 12.

The base 14 further includes a boss 32 extending from the upper surface thereof. The boss 32 is substantially cylindrical shaped. The outer wall 34 of the boss 32 is threaded to threadably received the housing 16. An internal cavity 36 is provided at the upper surface 38 of the boss 32. The cavity 36 is substantially cylindrical shaped and is located concentric with the boss 32 so as to receive the neck 40 of the $CO_2$ cartridge 18 (see FIG. 2). A needle 42 is provided for puncturing the face 44 of the neck 40 of the $CO_2$ cartridge 18. A gasket 45 is positioned at the bottom of the cavity 36 such that the face 44 may sealingly engage the cavity 36. More particularly, the needle 42 is rigidly positioned through the boss 32 to extend from the internal cavity 36 at the upper surface 38 of the boss 32 to the internal cavity 26 of the main body portion 24. The needle 42 comprises an internal passageway 46 along its entire length such that the interior of the container 12 will be in fluid communication with the interior of the $CO_2$ 18. The needle 42 is preferably solvent bonded within the main body portion 24 by well known solvent bonding techniques. Alternatively, although not shown, the needle 42 may be threaded into the main body portion 24.

Figure 2:
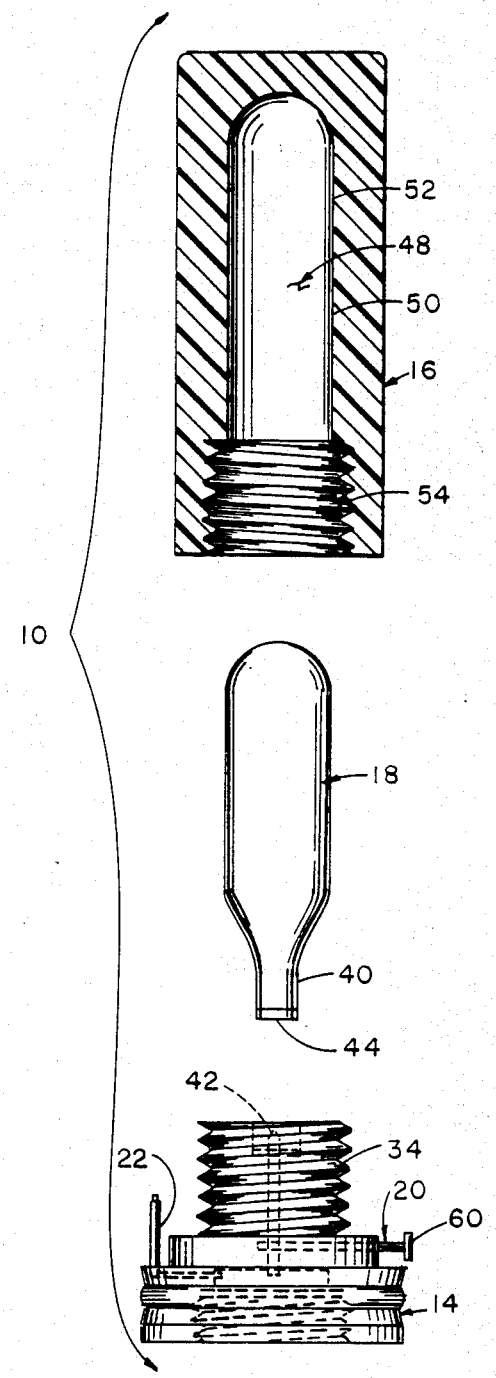
FIG. 2 is an exploded view of the device of the invention illustrating the $CO_2$ cartridge and the manner in which it is housed within the housing and the manner in which is pierced by the needle of the invention.

Referring to FIGS. 1 and 2, the housing 16 which houses the $CO_2$ cartridge 18 preferably comprises a substantially cylindrical configuration. The housing 16 includes an internal cavity 48 which is opened at the bottom end of the housing 16. The inside wall 50 of the cavity 48 includes an upper portion 52 and a lower portion 54. The lower portion 54 is threaded engagement with the threaded wall 34 of the boss 32 of the base 14. The upper portion 52 preferably comprises a configuration slightly larger or equal to the configuration of the $CO_2$ cartridge 18 such that the cartridge 18 is snugly housed by the housing 16. Also preferably, the longitudinal length of the internal cavity 48 is of a dimension sufficient to rigidly hold the face 44 of the cartride 18 in sealingly engagement with the gasket 45 when the housing 16 is threaded onto the boss 32. It should be appreciated that the longitudinal length of the internal cavity 48 may be slightly shorter than the desired length discussed above such that the face 44 of the cartridge 18 may be more securely seated against the gasket 45 by further tightening of the housing 16 onto the boss 32. Such a provision would also overcome any manufacturing tolerances existing in the manufacture of the $CO_2$ cartridges 18. As shown in FIG. 3 the valve 20 comprises a shaft 56 which is rotatably positioned diametrically through the upper portion 58 of the main body portion 24 of the base 14. A T-handle 60 is positioned at the protruding end of the shaft 56 of the valve 20. The shaft 56 extends through a hole 62 positioned diametrically through the needle 42. The diameter of the hole 62 and the diameter of the portion of the shaft 56 engagement therewith are equal such that the shaft 56 rotatably and sealingly engages through hole 62. A hole 64 is positioned diametrically through shaft 56 and aligned with the internal passageway 46 of the needle 42 when the shaft 56 and T-handle 60 are in the open position as shown in FIGS. 1 and 2. It should be appreciated that when the T-handle 60 is turned horizontally as shown in FIG. 3, hole 64 in the shaft 56 is moved from an open position in fluid communication with the internal passageway 46 of the needle 42 to a closed position traverse to the internal passageway 46. It should be appreciated that the diameter the size of hole 64 may be selected to limit the rate in which the gas from the $CO_2$ cartridge 18 is permitted to flow into the beverage container 12. Alternatively, a baffle means (not shown) may be affixed to the end of the internal passageway 46 of the needle 42 to partially block the gas flowing into the beverage container 12 such that the container 12 is not pressurized to rapidly.

The pressure gauge 22 of the invention comprises an outer cylindrical housing 66 having its lower portion 68 threadably engaged into the main body portion 24 of the base 14. A fluid communication passageway is provided from the bottom of the gauge 22 to a minor cavity 72 positioned above the internal cavity 26 of the main body portion 24 to permit the pressure within the container 12 to be sensed by the pressure gauge 22. More particularly, the pressure gauge 22 comprises an indicator rod 74 having a piston portion 76 secured to one end thereof. The piston portion 76 of the rod 74 is dimensioned to sealingly engage the inside wall of the cylindrical housing 66 to prevent the gas contained within the container 12 from leaking from the pressure gauge 22. A spring 78 is positioned about the indicator rod 74 between the upper surface of the piston portion 76 and the inwardly curved edges 80 of the cylindrical housings 66. The lower, middle, and upper segments of the indicator rod 74 may include indicia or may be color coded to indicate to the consumer the amount of pressure existing within the beverage container 12. Of course, the spring constant of the spring 78 is selected to correspond to the desired pressure within the beverage container 12. More particularly the spring constant of the spring 78 is selected such that one half of the length of the indicator rod 74 is forced out of the housing 66 when the desired amount of pressure exists within the beverage container 12. In this manner, when insufficient pressure is in the beverage container 12, the indicator rod 74 will be almost completely withdrawn into the cylindrical housing 66 by means of spring 78. Conversely, when the beverage container 12 becomes overcharged the full length of the rod 74 will be forced from the cylindrical housing 66.

During use, the consumer initially takes a new $CO_2$ 18 and inserts within the internal cavity 48 of the housing 16. The housing 16 and the cartridge 18 are then positioned onto the threaded boss 32 of the base 14. Upon tightening of the housing 16 onto the threaded boss 32, the neck 40 is guided into internal cavity 36. Upon further tightening of the housing 16 on the threaded boss 32, the needle 42 punctures the face 44 of the cartridge. Simultaneously, the face 44 of the cartridge 18 is seated against gasket 45.

The consumer then screws the device 10 onto the opened end of a beverage container 12. Valve 20 is then open to permit the gas contained within the $CO_2$ cartridge 18 to flow into the beverage container 12. As pressure increases within the container 12, the indicator rod 74 of the gauge 22 slowly moves from its recessed position inside of the cylindrical housing 66 to an extended position. When the appropriate amount of pressure has accumulated within the container 12, the consumer turns off valve 20 by rotating the T-handle 60 in the position illustrated in FIG. 3. It should be obvious that the beverage contained within the beverage container 12 remains charged by the pressurized gauge gas therein storage.

Upon the next use of the beverage in the beverage container 12, the device 10 is then simply unscrewed from the container 12. After use, the device 10 is then reinstalled in the same manner as described above. Of course, the $CO_2$ cartridge 18, when depleted, may be easily replaced with another new cartridge 18.

The above discussion has described the device 10 of the invention in particular detail in connection with a beverage container 12. It shall be understood that the device 10 may be easily incorporated in any other type of container which contains any other type of fluid or solid which should be stored under pressure. In particular, the device 10 of the invention may be easily used in conjunction with alcoholic beverages such as beer.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the specific steps of the process may be restored without departing from the spirit and scope of this invention.

Now that the invention has been described,

What is claimed is:

1. A filling device for filling a container with a pressurized gas from a cartridge having a face portion, comprising in combination:

a base for connection to the container, a housing including a first cavity operatively connected to said base for housing the cartridge containing the pressurized gas;

a fluid passageway extending from said housing through said base for fluid communication with the interior of the container;

means for puncturing the face of the cartridge to permit the gas contained therein to flow through said fluid passageway into the container; and valve means for controlling the flow of gas through said fluid passageway;

wherein said valve includes a shaft which extends through said base to engage said fluid passageway;

wherein said shaft includes a hole which is aligned with said fluid passageway when said valve is in the "on" position and is misaligned with said fluid passageway when the valve is in the "off" position;

further including a pressure gauge for sensing the pressure on the gas contained within the container;

wherein said pressure gauge includes an indicator rod to provide a visual indication of the pressure of the interior of the container;

wherein said indicator rod of said pressure gauge is color coded to indicate over-charging, under-charging, and the desired pressure of the container.

* * * * *